US010240375B2

(12) United States Patent
Brunnmayr

(10) Patent No.: US 10,240,375 B2
(45) Date of Patent: Mar. 26, 2019

(54) PIECE OF FURNITURE

(71) Applicant: Julius Blum GmbH, Hoechst (AT)

(72) Inventor: Harald Brunnmayr, Hoerbranz (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 15/669,188

(22) Filed: Aug. 4, 2017

(65) Prior Publication Data

US 2017/0335611 A1 Nov. 23, 2017

Related U.S. Application Data

(63) Continuation of application No. PCT/AT2016/000010, filed on Feb. 11, 2016.

(30) Foreign Application Priority Data

Feb. 13, 2015 (AT) ..... A 73/2015

(51) Int. Cl.
*E05D 3/14* (2006.01)
*E05D 15/26* (2006.01)
(Continued)

(52) U.S. Cl.
CPC ..... *E05D 3/142* (2013.01); *E05D 5/0276* (2013.01); *E05D 7/00* (2013.01); *E05D 11/1021* (2013.01);
(Continued)

(58) Field of Classification Search
CPC ..... E05D 3/142; E05D 5/0276; E05D 7/00; E05D 11/1021; E05D 15/262;
(Continued)

(56) References Cited

U.S. PATENT DOCUMENTS 5,882,099 A * 3/1999 Salice ..... E05D 15/262 160/207
6,332,660 B1 * 12/2001 Salice ..... E05D 15/262 160/207
(Continued)

FOREIGN PATENT DOCUMENTS

CN 1589360 3/2005
CN 101040094 9/2007
(Continued)

OTHER PUBLICATIONS

International Search Report dated May 11, 2016 in International (PCT) Application No. PCT/AT2016/000010.
(Continued)

*Primary Examiner* — Hanh V Tran
(74) *Attorney, Agent, or Firm* — Wenderoth, Lind & Ponack, L.L.P.

(57) ABSTRACT

An article of furniture, comprising a furniture carcass, includes a two-part furniture flap having a first flap part, and a second flap part, and at least one support device for the two-part furniture flap. The at least one support device is connected to the furniture carcass and the two-part furniture flap in an articulated manner. The at least one support device has a transmission portion, which is on an inside of the first flap part and defines a setting angle of the second flap part to the first flap part according to a setting angle of the first flap part.

30 Claims, 20 Drawing Sheets

(51) Int. Cl.

| | |
|---|---|
| ***E05F 15/60*** | (2015.01) |
| ***E05D 5/02*** | (2006.01) |
| ***E05D 7/00*** | (2006.01) |
| ***E05D 11/10*** | (2006.01) |
| ***E05F 1/12*** | (2006.01) |

(52) U.S. Cl.
CPC ..... *E05D 15/262* (2013.01); *E05D 15/264* (2013.01); *E05F 1/1246* (2013.01); *E05F 15/60* (2015.01); *E05Y 2201/62* (2013.01); *E05Y 2201/624* (2013.01); *E05Y 2201/708* (2013.01); *E05Y 2900/20* (2013.01)

(58) Field of Classification Search
CPC ..... E05D 15/264; E05F 15/60; E05F 1/1246; E05Y 2201/62; E05Y 2201/624; E05Y 2201/708; E05Y 2900/20
See application file for complete search history.

(56) References Cited

U.S. PATENT DOCUMENTS

| | | | | |
|---|---|---|---|---|
| 6,877,830 | B2 | 4/2005 | Salice | |
| 7,240,974 | B2 | 7/2007 | Hirtsiefer | |
| 7,448,703 | B2 | 11/2008 | Küng | |
| 7,694,459 | B2 | 4/2010 | Brunnmayr | |
| 7,707,687 | B2 | 5/2010 | Giovannetti | |
| 7,976,079 | B2 | 7/2011 | Hirtsiefer | |
| 9,631,411 | B2 * | 4/2017 | Lutz | E05D 11/1064 |
| 9,909,346 | B2 * | 3/2018 | Holzapfel | E05D 15/401 |
| 2002/0108311 | A1 | 8/2002 | Salice | |
| 2004/0239213 | A1 | 12/2004 | Hirtsiefer | |
| 2006/0174444 | A1 | 8/2006 | Giovannetti | |
| 2007/0209157 | A1 | 9/2007 | Kung | |
| 2007/0257538 | A1 * | 11/2007 | Brunnmayr | E05D 15/262 297/423.12 |
| 2008/0134464 | A1 * | 6/2008 | Salice | E05F 1/1058 16/84 |
| 2008/0196203 | A1 * | 8/2008 | Giovannetti | E05D 3/14 16/239 |
| 2008/0216289 | A1 * | 9/2008 | Salice | E05D 3/142 16/366 |
| 2009/0072551 | A1 | 3/2009 | Hirtsiefer | |
| 2010/0282418 | A1 * | 11/2010 | Lucas | E04F 10/10 160/54 |
| 2011/0197639 | A1 * | 8/2011 | Hauer | E05D 15/262 70/174 |
| 2012/0049709 | A1 * | 3/2012 | Scheffknecht | E05D 15/262 312/319.6 |
| 2013/0334944 | A1 * | 12/2013 | Karg | E05D 15/262 312/237 |

FOREIGN PATENT DOCUMENTS

| | | |
|---|---|---|
| CN | 101061287 | 10/2007 |
| CN | 101610699 | 12/2009 |
| DE | 1 529 652 | 1/1970 |
| DE | 1 814 224 | 6/1970 |
| DE | 20 2013 007 519 | 11/2013 |
| EP | 1 662 082 | 5/2006 |
| EP | 1 959 077 | 8/2008 |
| JP | 2002-227513 | 8/2002 |
| JP | 2008-520856 | 6/2008 |
| JP | 2008-537075 | 9/2008 |

OTHER PUBLICATIONS

Search Report dated Dec. 3, 2015 in Austrian Application No. A 73/2015, with English translation.
English Translation of Search Report dated Jul. 10, 2018 in Chinese Application No. 201680015991.8.

* cited by examiner

PIECE OF FURNITURE

BACKGROUND OF THE INVENTION

1. Field of the Invention

The present invention concerns an article of furniture comprising a furniture carcass, a two-part furniture flap having a first flap part—preferably arranged upwardly in a mounted position—and a second flap part—preferably arranged downwardly in a mounted position—and at least one support device for the furniture flap, wherein the support device is hingedly connected to the furniture carcass and the furniture flap, and a support device for a two-part furniture flap.

2. Description of Related Art

Articles of furniture with support devices for two-part furniture flaps as well as such support devices per se are known in many different configurations from the state of the art like for example EP 1 959 077 A1 and DE 1529652 B1. For supporting and moving for example two-part upwardly folding flaps of such articles of furniture in that respect use is usually made of a control arm which acts on one of the hingedly connected flap parts thereof. By virtue of a control arm which is usually pivotable about a horizontal axis, an articulated furniture flap can be guided and also supported in the opening and closing movements. A disadvantage with the articles of furniture known in the state of the art, having such control devices for moving the furniture flaps, is the control arm which is separate from the flap parts. When opening the furniture flap the arm usually pivots out of the interior of the carcass of the article of furniture and usually also still projects therefrom in the open position of the furniture flap, in particular if the arm acts on the lower flap part of a two-part upwardly folding flap. By virtue of the control arm of such a support device, that pivots outwardly and projects from the interior of the furniture carcass, besides causing difficulty in gaining lateral access to the interior of the furniture carcass when the furniture flap is opened, injuries can also occur due to the hand or finger of a user being pinched between the control arm and the furniture carcass or a flap part.

SUMMARY OF THE INVENTION

Therefore the object of the present invention is to provide an article of furniture which is improved over the state of the art, having a furniture carcass, a two-part furniture flap and a support device hingedly connected to the furniture carcass and the furniture flap, as well as such a support device for a two-part furniture flap.

In particular the invention seeks to provide that the above-mentioned disadvantages are overcome and an article of furniture and a support device are provided for the user, which substantially enhance operating comfort and convenience and the aesthetics and minimize a risk of injury.

The specified object is attained by an article of furniture of the present disclosure and a support device of the present disclosure. Advantageous embodiments of the invention are defined in the appendant claims.

By virtue of the fact that the support device has a transmission portion which is arranged at the inside of the first flap part and which in dependence on the setting angle of the first flap part establishes the setting angle of the second flap part relative to the first flap part, tilting of the second flap part which is preferably arranged downwardly in a mounted position can be caused in an opening or closing movement of the furniture flap, in dependence on the position of the first flap part which is preferably arranged upwardly in a mounted position, within the opening or closing movement of the furniture flap. By virtue of that tilting movement which can be characterized by a setting angle between the first and second flap parts, wherein that setting angle is in turn dependent on the setting angle, corresponding to the opening or closing position, of the first flap part relative to the furniture carcass, it is possible to achieve almost perpendicular displacement of the second flap part upon opening or closing of the flap of the article of furniture. This has the effect that the second flap part which is preferably the lower one in a mounted position, upon opening or closing of the furniture flap, does not pivot substantially further out of the furniture carcass than the first flap part which is preferably the upper one in a mounted position, thereby affording a user more comfortable and convenient opening or closing movement. The transmission portion of the support device, that establishes the setting angle, is arranged in that case at the inside, that is to say at the side of the first flap part that is towards the interior of the furniture carcass, thereby making it possible to achieve an extremely compact support device which in any position substantially follows the contour of the flap parts of the furniture flap and which manages without additional parts projecting from the interior of the furniture carcass. An article of furniture having such a support device is distinguished by particularly easy lateral accessibility into the interior of the furniture carcass, a high level of aesthetics and operational safety. The compact structure of the furniture flap with a support device according to the invention makes it possible to achieve optimized utilization of space in the interior of the article of furniture.

By virtue of the fact that the transmission portion of the support device is hingedly connected to the furniture carcass by way of a first hinge lever at a first articulation point—which is preferably arranged upwardly in a mounted position—it is possible to provide an advantageous connection for the transmission portion with respect to the furniture carcass which is stationary relative thereto upon opening or closing of the furniture flap. Thus, upon opening or closing of the furniture flap and upon pivotal movement linked thereto of the flap part which is preferably arranged upwardly in a mounted position, together with the transmission portion arranged thereon at the inside, the movement can be effectively transmitted to the transmission portion for a large range of pivotal movement. In addition that permits the transmission portion to be arranged at an inward position over a large portion of the first flap part. The transmission ratio can also be adapted to the transmission of the opening or closing movement by the respective configuration of the first hinge lever and the transmission portion.

The fact that the first articulation point is arrange at a first end of the transmission portion makes it possible to utilize a maximum displacement travel of the transmission portion. In addition this can also enable the support device to be of a compact structure.

By virtue of the fact that the transmission portion of the support device is hingedly connected to the second flap part by way of a second hinge lever at a second articulation point—which is preferably arranged downwardly in the mounting position—it is possible to permit advantageous transmission of the pivotal movement occurring in the opening or closing movements of the furniture flap in respect of the first flap part at the second flap part which is preferably arranged downwardly in a mounted position by means of the transmission portion. The transmission ratio of the pivotal movement which is dependent on the setting angles of the flap parts can be adjusted by the respective configuration of the second hinge lever and the transmission portion. The connection by way of a second hinge lever also permits the transmission portion to be arranged inwardly over a large portion of the first flap part.

The fact that the second hinge lever is hingedly connected to the second flap part by way of a fitting can provide an additional possible way of adjusting the transmission ratio in transmission of the setting angles of the flap parts. Thus for example a support device can be adapted to flap parts of differing proportions of a furniture flap by way of the dimensions of the fitting. The connection by way of a fitting can also permit an in particular integrated, easily adjustable, easily fittable configuration for the support device.

By virtue of the fact that the second articulation point is arranged at the second end of the transmission portion it is possible to exploit a maximum displacement travel of the transmission portion and it is also possible for the furniture flap with the support device to be of a compact structure.

The fact that the first flap part is connected to the furniture carcass by way of a first hinged connection, preferably by way of a first furniture hinge, can also provide a connection between the first flap part and the carcass of the article of furniture, which permits a pivotal movement of the first flap part upon opening or closing of the furniture flap. In that case, that first hinged connection can be part of the support device, thereby permitting the support device to be of a particularly integrated and compact design. With a connection by way of a first furniture hinge moreover this can permit easy mounting and alignment of the first flap part. Means for damping the closing movement of the furniture flap can also be provided in that first hinged connection.

By virtue of the fact that the first flap part is connected to the second hinge part by way of a second hinged connection, preferably by way of a second furniture hinge, the first and second flap parts can be joined together in a particularly advantageous manner to provide a two-part furniture flap, in particular a two-part furniture flap in the form of an upwardly foldable flap. That second hinged connection can also permit guidance of the pivotal movement of the second hinge part relative to the first hinge part, which movement can be characterized by the setting angle between the first and the second flap parts. In that case the second hinged connection can be part of the support device, which can contribute to a particularly compact and integrated design for the support device. Means for damping the closing movement can also be provided in the second hinged connection. When the second hinged connection is afforded by way of a second furniture hinge mounting and alignment of the second flap part on the support device and thus the article of furniture can be facilitated.

By virtue of the fact that the second hinge lever is connected to the second flap part in a mounted position beneath the pivot point of the second hinged connection connecting the flap parts, this affords a particularly advantageous arrangement for the connection of the second hinge lever and the second hinged connection of the first and second flap parts. The parts of the support device, which are disposed inwardly on the furniture flap, can thus substantially follow the contour of the furniture flap in any position thereof.

The fact that the transmission portion of the support device and the first and/or the second hinge lever are substantially aligned with each other in the closed position of the furniture flap makes it possible to achieve a particularly compact structure for the support device. Such a structure is distinguished by requiring an extremely small amount of space in the closed position, whereby this can afford optimum utilization of the space in the interior of the furniture carcass.

By virtue of the fact that the transmission portion of the support device and the first and/or the second hinge lever are substantially aligned with each other in the open position of the furniture flap, it is possible to achieve a configuration for the furniture flap with the support device, that is particularly compact in terms of its action for a user, in which case an article of furniture with a furniture flap having such a support device is distinguished by particularly good lateral accessibility to the interior of the furniture carcass. That also makes it possible to achieve a high level of aesthetics and operating safety for the article of furniture.

By virtue of the fact that the ratio of the longitudinal extent of the first and/or the second hinge lever to the longitudinal extent of the transmission portion of the support device is less than or equal to 1/2 it is possible for the transmission ratio in terms of transmission of the setting angle of the first flap part to the setting angle of the second flap part in relation thereto to be adapted in a range which, in an opening or closing movement of the furniture flap, allows a sufficiently large pivotal movement of the second flap part relative to the first flap part and at the same time permits a stable and compact design for the support device with an arrangement of the transmission portion, which extends in an inward location over a large portion of the first flap part.

By virtue of the fact that the transmission portion of the support device is guided at least sectionwise by a guide substantially linearly at a guide portion which is displaceable relative thereto, it is possible to ensure that in an opening or closing movement of the furniture flap, the transmission portion remains disposed at the inside of the first flap part, and thus effective transmission of the setting angle of the first flap part to the second flap part can take place.

By virtue of the fact that the guide is a positive guide means, preferably with a grooved rail, it is possible to achieve simple, compact and integrated guidance for the transmission portion. In addition, by virtue of a positive guide means, preferably with a grooved rail, the forces which occur can be optimally transmitted in the axial direction and also lateral or torsion-induced forces which occur upon opening or closing of the furniture flap can be absorbed by the support device without the function thereof being disrupted thereby. In that case the grooved rail can be in the form of a guide groove formed at least sectionwise on the guide portion, with the transmission portion engaging behind same.

By virtue of the fact that the guide portion of the support device is fixed at the inside of the first flap part it is possible to achieve a particularly compact and simple structure for the support device and also the article of furniture.

The fact that the guide portion is connected to the first and/or the second hinged connection makes it possible to provide additional options for fixing the first flap part to the support device, whereby it is possible to achieve a stable configuration for the article of furniture. In that case the guide portion can also extend from the first hinged connection to the second hinged connection and can be connected thereto, whereby this can provide a particularly stable configuration for the article of furniture, which can be easily assembled. In that case the guide portion can have a structure which is continuous or which is also only sectionwise, being suitable for guiding the transmission portion.

Because the ratio of the longitudinal extent of the transmission portion of the support device to the height of the first flap part is at least equal to or greater than 1/3, preferably at least equal to or greater than 1/2, this can provide a configuration for the support portion of the support device, which has a compact action for a user and which is disposed inwardly over large portions of the first flap part. Such dimensions can also provide a stable furniture flap.

By virtue of the fact that the support device has an electrical and/or spring-loaded mechanical drive the movement of the furniture flap can be assisted or can also be actively moved, which enhances the operating comfort and convenience for a user. In addition the furniture flap after opening can be at least temporarily held in an open position by such a drive. Furthermore the furniture flap can be held in a closed position in which it is acted upon by force, by such a drive.

By virtue of the fact that the spring-loaded mechanical drive has a force storage means, preferably at least one spring, wherein a control cam or a multi-link kinematic arrangement can be acted upon with force by the force storage means, the drive can be provided in a simple, inexpensive and robust fashion which involves few parts. The position-dependent force required for folding the furniture flap upwardly can be easily applied by a control cam or a multi-link kinematic arrangement, in dependence on the setting angle of the first flap part relative to the furniture carcass.

By virtue of the drive acting on the first hinge lever it is possible to provide an integrated and compact structure for the support device, wherein the first hinge lever can be integrated into the drive and can thus also perform a dual function.

A support device for a two-part furniture flap is also disclosed.

A particularly advantageous configuration of such a support device can be achieved by the combination thereof with at least one of the above-mentioned features relating thereto.

BRIEF DESCRIPTION OF THE DRAWINGS

Further details and advantages of the present invention will be described more fully hereinafter by means of the specific description with reference to the embodiments by way of example illustrated in the drawing in which.

DETAILED DESCRIPTION OF THE INVENTION

Figure 1:
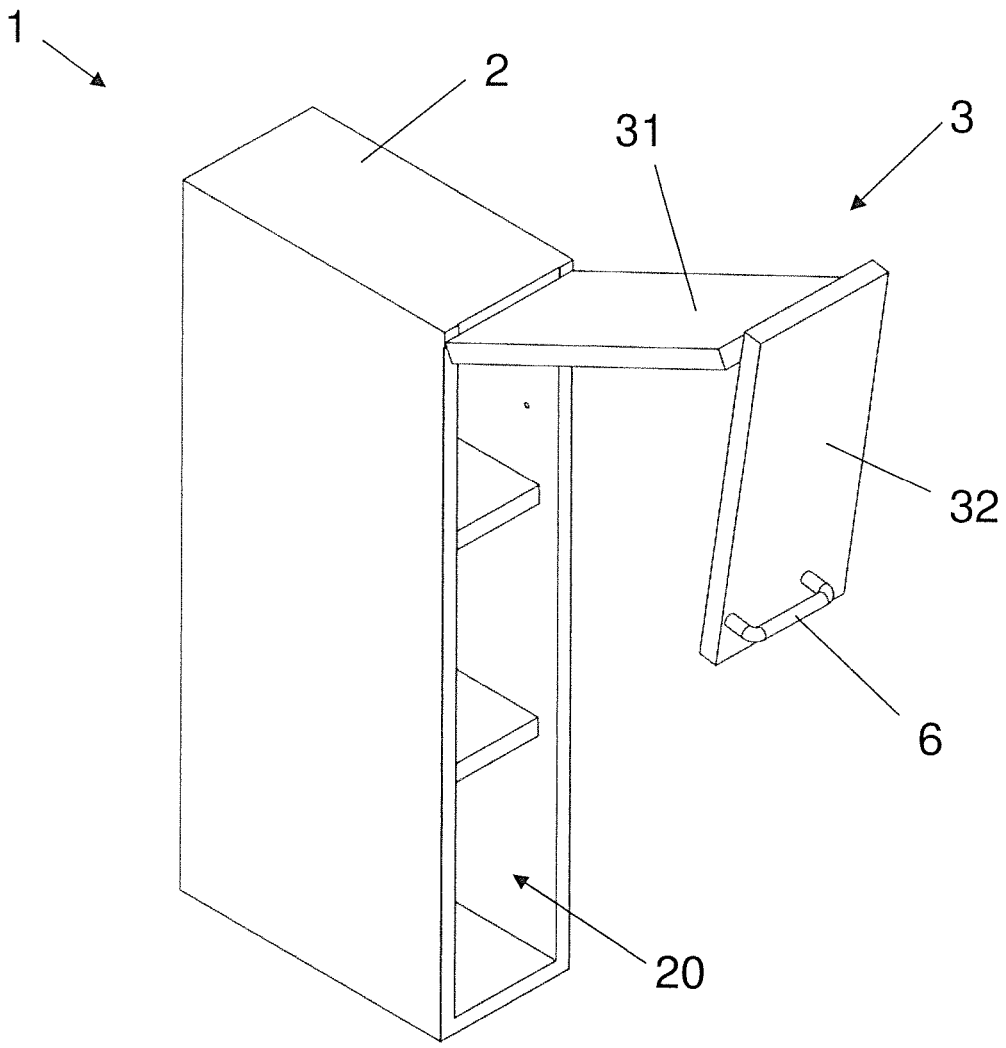
FIG. 1 shows a perspective view of an article of furniture with a two-part furniture flap.

FIG. 1 shows an article of furniture 1 with a two-part furniture flap 3 fixed to a furniture carcass 2 in an upwardly folded, that is to say opened, position. In this arrangement the two-part furniture flap 3 comprises a first flap part 31 and a second flap part 32, wherein there is provided a handle 6 for better operability by a user at the lower edge of the second flap part 32. The support device 4 is concealed by the furniture flap 3 in this view.

Figure 2:
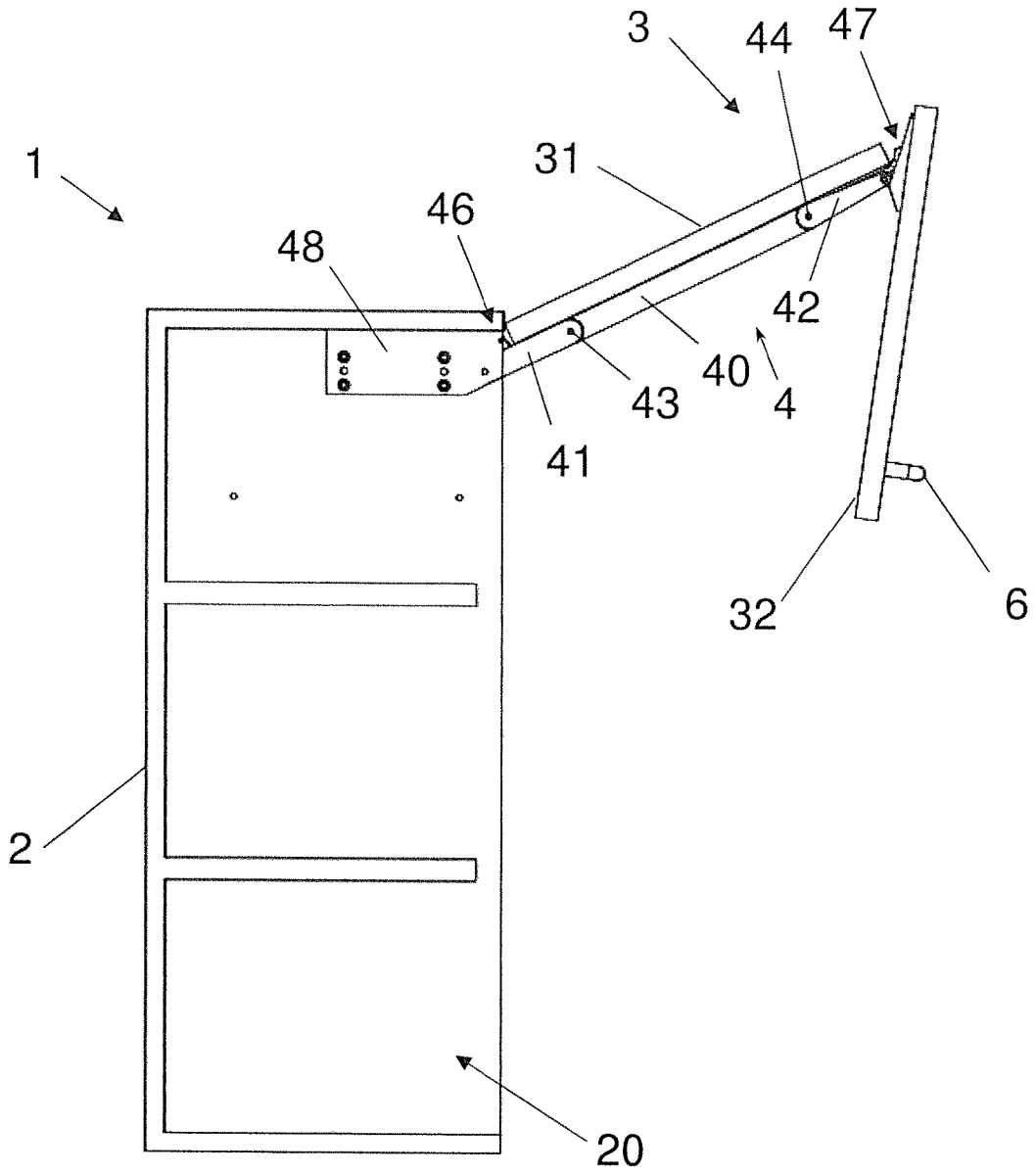
FIG. 2 shows a sectional side view of an article of furniture with a two-part furniture flap and a support device in a completely opened position.

FIG. 2 shows a sectional side view of an article of furniture 1 in an opened position approximately corresponding to FIG. 1. In this arrangement the article of furniture comprises the furniture carcass 2, the support device 4 fixed thereto and the two-part furniture flap 3 with a first flap part 31 and a second flap part 32. A handle 6 for actuation of the furniture flap 3 is provided on the second flap part 32. The housing 48 of the support device 4 is mounted in an upwardly disposed region of the furniture carcass 2, in which case mounting of the support device 4 can be effected at a side wall of the furniture carcass 2 or also at the underside of the top panel of the furniture carcass 2. The first flap part 31 of the furniture flap 3 is connected to the housing 48 by way of a first hinged connection 46. As will be further apparent hereinafter this first hinged connection can be a four-point concealed cup hinge. The first flap part 31 can also additionally be fixed to a guide portion 45 of the support device 4. The second flap part 32 is connected to the first hinge part 31 with a second hinged connection 47. The second hinged connection 47 between the flap parts 31, 32 can be a two-point concealed cup hinge, as will be further apparent hereinafter. The first hinge lever 41 is also mounted rotatably to the housing 48. That first hinge lever 41 engages the transmission portion 40 at a first articulation point 43. The second hinge lever 42 in turn engages the second articulation point 44 of the transmission portion 40. The second hinge lever 42 is hingedly connected to the second flap part 32, in the embodiment shown here that connection is made by way of the second hinged connection 47. In this position corresponding to the open position of the furniture flap 3 the first hinge lever 41, the transmission portion 40 and the second hinge lever 42 are substantially aligned with each other. It will also be clearly visible from this view that access to the interior 20 of the furniture carcass 2 is not impeded by components projecting therefrom. The support device 4 can also have an electric drive 5 which cannot be seen from the exterior.

Figure 3:
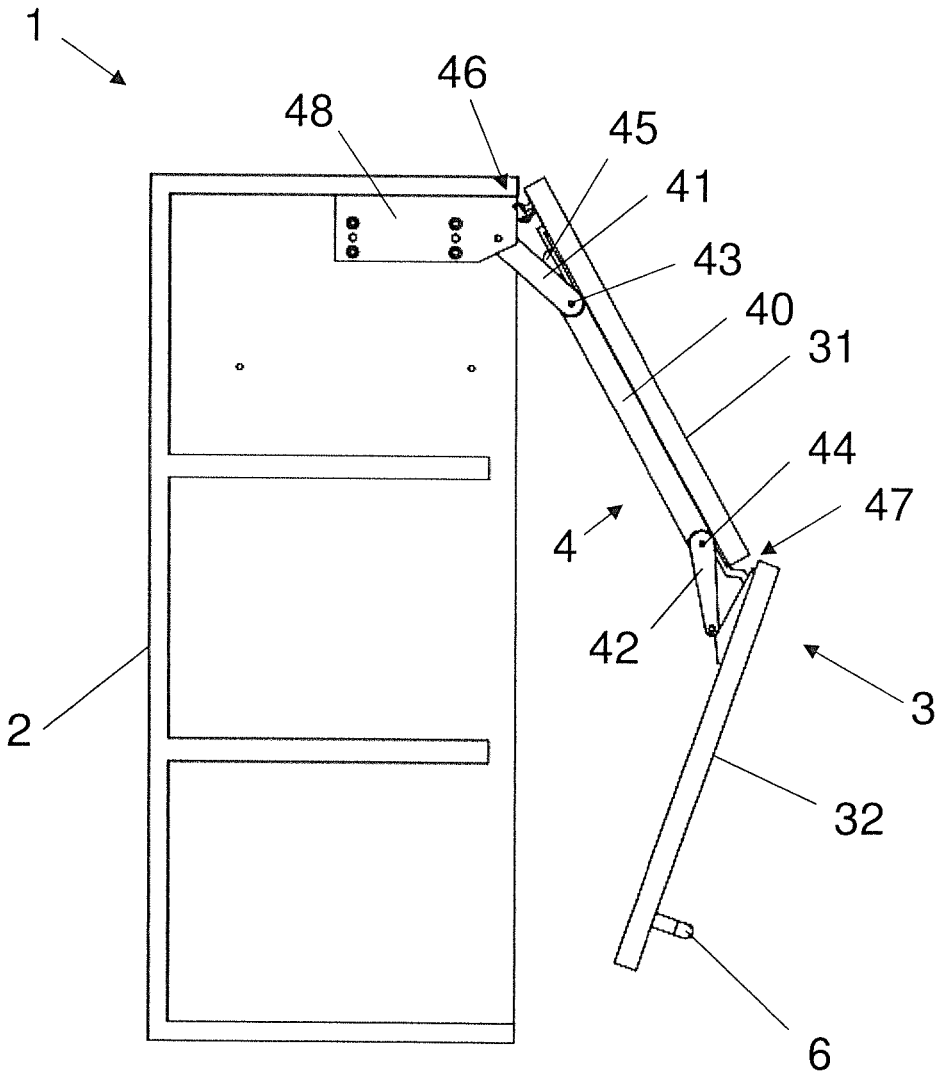
FIG. 3 shows a sectional side view of an article of furniture with a two-part furniture flap and a support device in an intermediate position.

In the sectional view of the article of furniture 1 shown in FIG. 3 the two-part furniture flap 3 is in an intermediate position between the completely opened and the completely closed state. The pivotal movement of the first hinge lever 41, which is caused by the setting angle of the first flap part 31 which is reduced in comparison with FIG. 2, relative to the furniture carcass 2, is transmitted by the transmission portion 40 to the setting angle between the second flap part 32 and the first flap part 31 with the second hinge lever 42 so that upon closure of the two-part furniture flap 3 there is a pivotal movement of the second flap part 32 with respect to the first flap part 31. Transmission of the setting angle of the first flap part 31 to the setting angle of the second flap part 32 in relation thereto is made possible by the transmission portion 40 which is guided linearly on a guide portion 45 and which bears against the inside of the first flap part 31 over the entire range of pivotal movement, and thus allows controlled pivotal movement of the second flap part 32 with respect to the first flap part 31 upon opening or closing of the two-part furniture flap 3.

Figure 4:
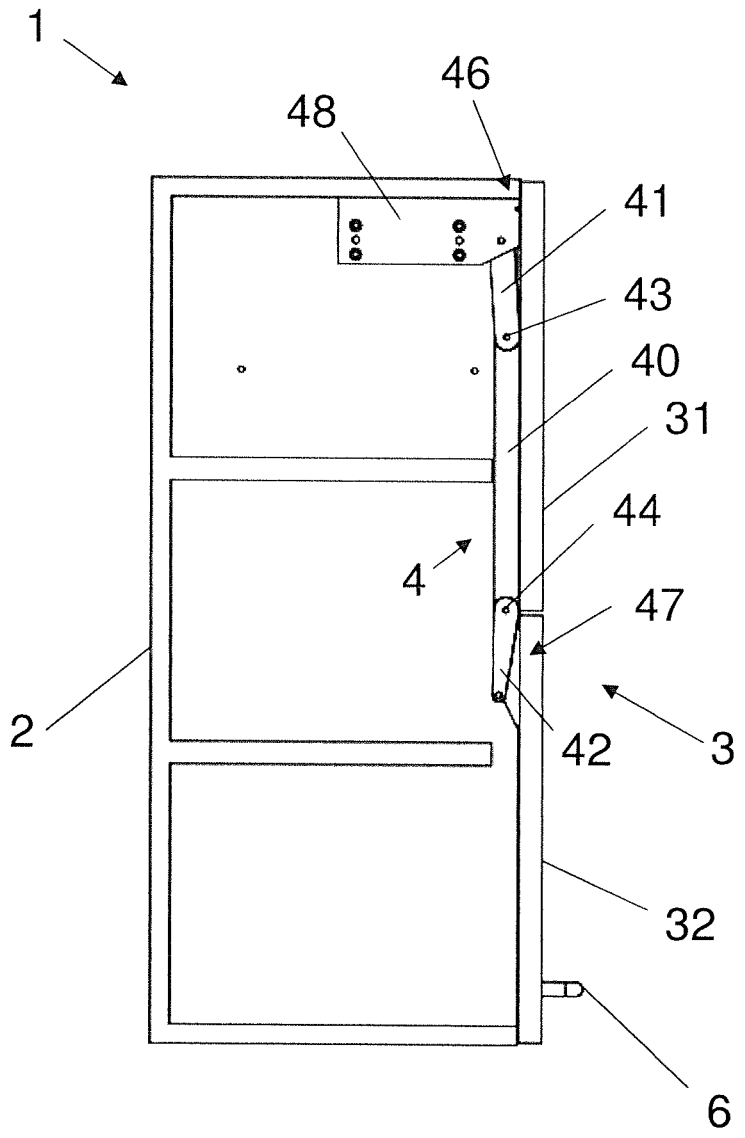
FIG. 4 shows a sectional side view of an article of furniture with a two-part furniture flap and a support device in a closed position.

FIG. 4 shows an article of furniture 1 in a completely closed position of the two-part furniture flap 3. The first hinge lever 41, the transmission portion 40 and the second hinge lever 42 of the support device 4 are substantially in alignment with each other in this closed position of the two-part furniture flap 3, whereby the amount of space required by the support device 4 can turn out to be very small.

Figure 5C:
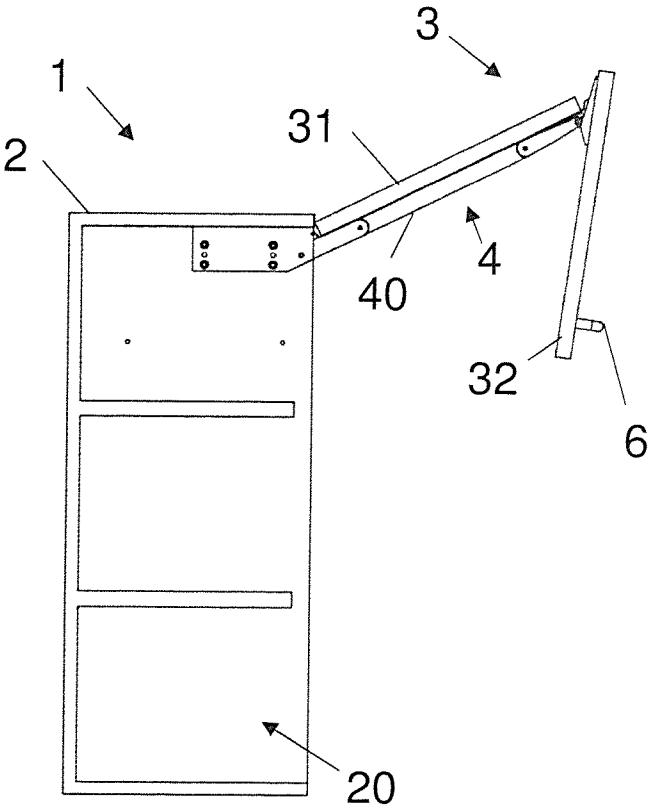
FIGS. 5*a*-5*c* show a sectional side view of an article of furniture with a two-part furniture flap and a support device upon an opening or closing movement.
Figure 5B:
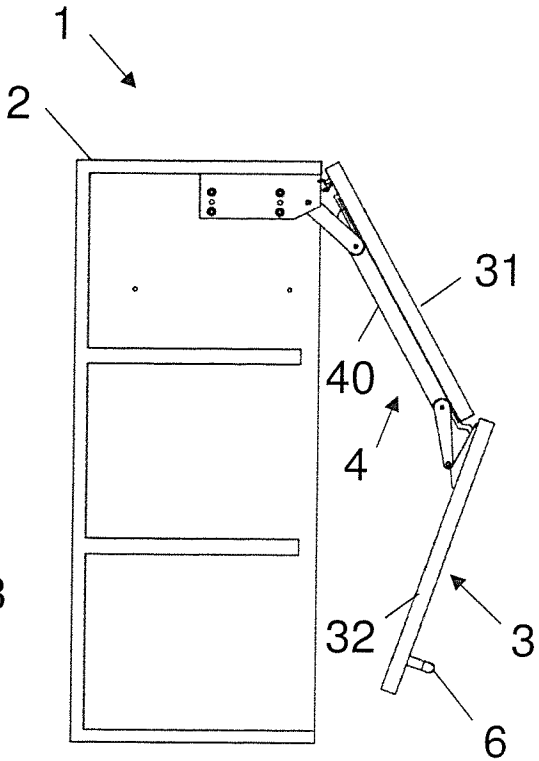
Figure 5A:
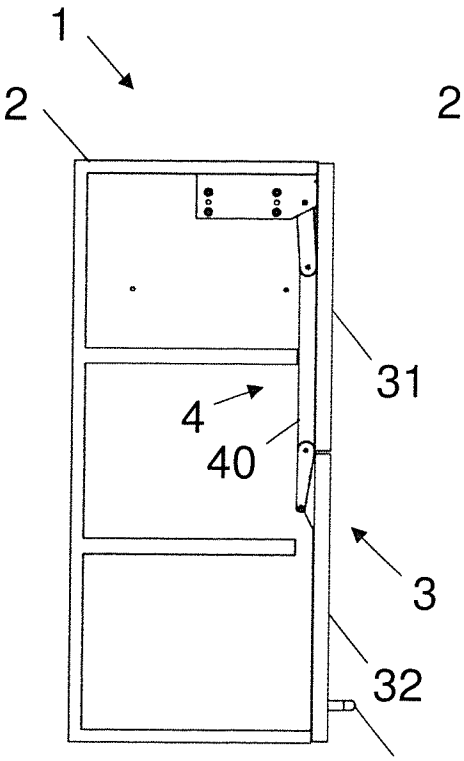

FIGS. 5*a* through 5*c* show the opening and closing movement of a two-part furniture flap 3 of an article of furniture 1. In this respect FIG. 5*a* shows an article of furniture 1 with a completely closed two-part furniture flap 3, FIG. 5*b* shows an article of furniture 1 with a two-part furniture flap 3 in a partially opened or closed position and FIG. 5*c* shows an article of furniture 1 with a completely opened two-part furniture flap 3. In that respect it can be clearly seen that upon opening or closing of the two-part furniture flap 3 the downwardly arranged second flap part 32 is pivoted with respect to the first flap part 31 by the support device 4 in such a way that it is displaced almost perpendicularly upwardly and downwardly respectively. That is contrary to operating comfort and convenience for a user as upon opening or closing of the two-part furniture flap the lower second flap part 32 in that case pivots substantially no further out from the furniture carcass 2 than the lower edge of the upper first flap part 31. In that case, the part of the support device 4 which bears against the inside of the first flap part 31 substantially follows the contour of the two-part furniture flap 3 and thus permits optimum accessibility for a user to the interior 20 of the furniture carcass 2. Optimum operating safety is also achieved by the elimination, which is made possible in that way, of any additional control elements which are provided separately from the flap parts 31, 32 and which project from the furniture carcass 2.

Figure 6:
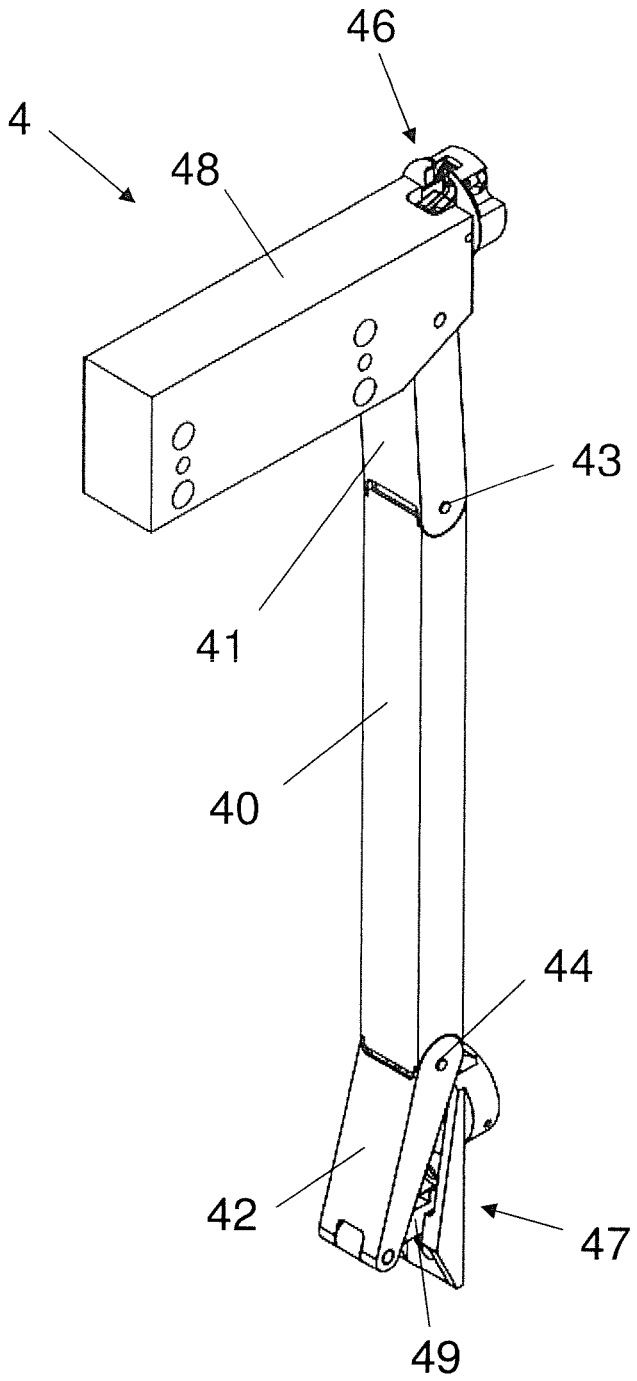
FIG. 6 shows a perspective view of a support device in a closed position.

FIG. 6 shows a perspective rear view of a support device 4 in a position corresponding to a closed position of a two-part furniture flap 3 (not shown). In this case the housing 48, the first hinge lever 41 hingedly fixed thereto, the transmission portion 40 connected thereto at a first articulation point 43 and the second hinge lever 42 hingedly connected thereto at the second articulation point 44 can be clearly seen. In this view the guide portion 45 which is connected to the first hinged connection 46 and the second hinged connection 47 is concealed. In this embodiment the second hinge lever 42 is connected to the second hinged connection 47 by way of a fitting 49. The transmission ratio in terms of transmission of the setting angles of the flap parts 31, 32 of a furniture flap 3, that are provided for mounting to the hinged connections 46, 47, can be adjusted by the fitting 49 in addition to the transmission ratio provided by the proportions of the hinge levers 41, 42 to the transmission portion 40. When using a fitting 49 the first hinge lever 41, the transmission portion 40 and the second hinge lever 42 can further be substantially in alignment with each other.

Figure 7:
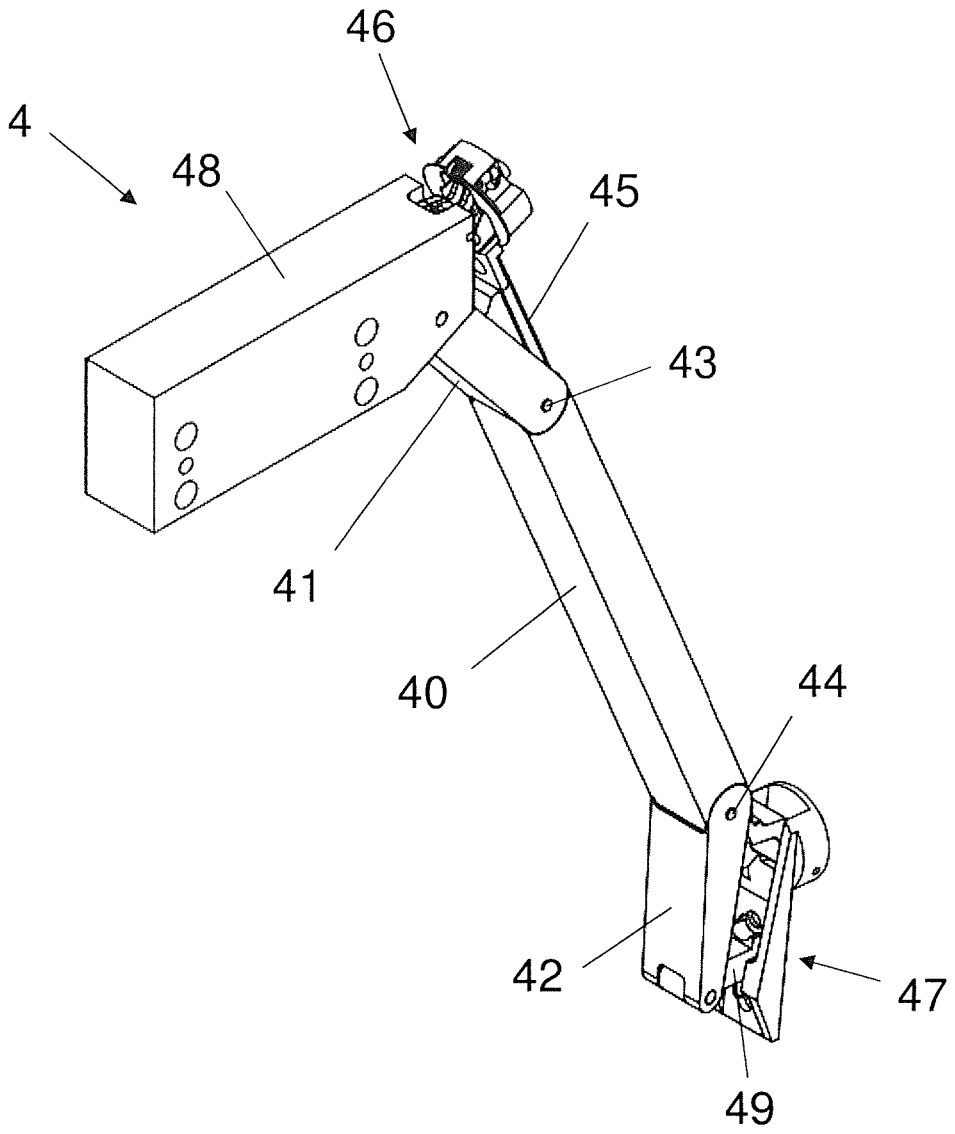
FIG. 7 shows a perspective view of a support device in an intermediate position.

FIG. 7 shows a perspective rear view of a support device 4, the position of which corresponds to a partially opened or closed position of a two-part furniture flap 3 (not shown). In that respect it can be seen that the first hinged connection 46 connected to the housing 48, in this embodiment in the form of a four-link concealed cup hinge, is partially opened. A part of the guide portion 45 is also visible by virtue of the pivotal movement of the first hinge lever 41 in that position of the support device 4. By virtue of the linear relative movement caused by the pivotal motion between the transmission portion 40 and the guide portion 45, the second hinged connection 47 by way of the second hinge lever 42 and the fitting 49 can be so modified in its setting angle that a flap part 32 intended for mounting thereto would be held in an almost perpendicular position.

Figure 8:
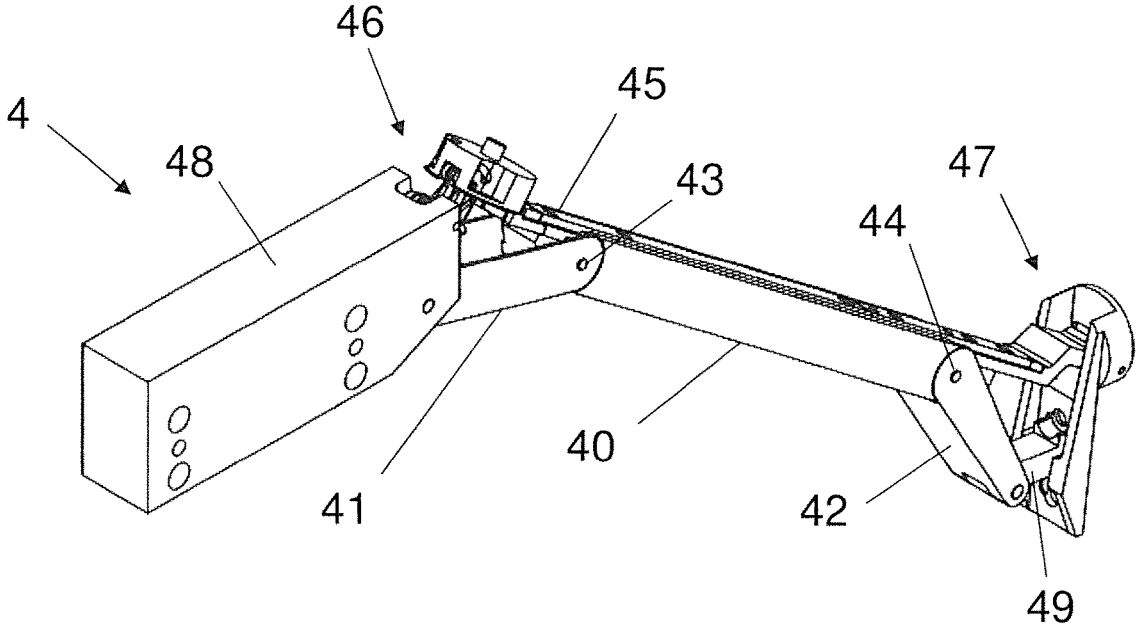
FIG. 8 shows a further perspective view of a support device in an intermediate position.

FIG. 8 shows a perspective rear view of a support device 4, the position of which corresponds to an almost completely opened two-part furniture flap 3. The first hinged connection 46 which in this embodiment is in the form of a four-link concealed cup hinge, is equally disposed in an almost opened condition. The transmission portion 40 which is guided linearly at the guide portion 45 has moved in this position of the support device 4 relative thereto from a lower end of the guide portion 45—presupposing an opening movement—in the direction of an upper end of the guide portion 45, and thus transmitted a pivotal movement of the first hinged connection 46 to the second hinged connection 47 by way of the second hinge lever 42 and the fitting 49.

Figure 9:
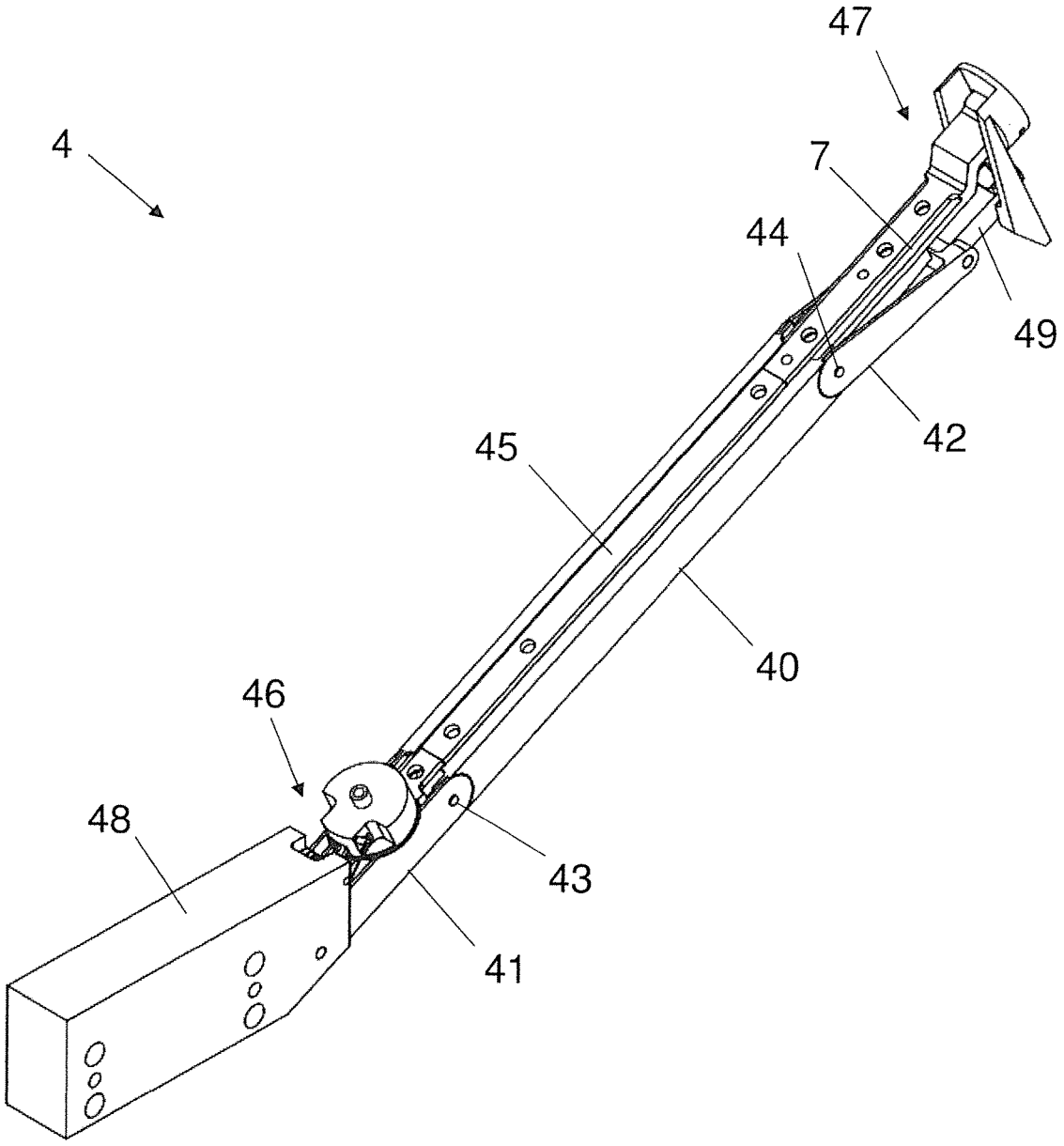
FIG. 9 shows a perspective view of a support device in an opened position.

FIG. 9 shows a perspective rear view of a support device 4 in a position corresponding to a completely opened two-part furniture flap 3. The first hinged connection 46 which is in the form of a four-point hinge, between the housing 48 and the guide portion 45, is disposed in this case in an open position, in other words a pivoted outwardly or also extended position, and the second hinged connection 47 in the form of a two-point concealed cup hinge, between the guide portion 45 and the second hinge lever 42, is in a closed position, in other words in an angled-in or folded-in position. The transmission portion 40 is displaced with respect to the guide portion 45 to the maximum in the direction of the first hinged connection 46, which is characteristic of the position of the support device 4, that corresponds to the opened position of a two-part furniture flap 3. In this embodiment the positive guidance is afforded by the transmission portion 40 engaging behind the guide groove 6 provided on the guide portion 45. The desired tilting movement of the second hinged connection 47 in the position of the support device 4, that corresponds to the opened position, can be adjusted by way of the dimensions of the fitting 49.

Figure 10A:
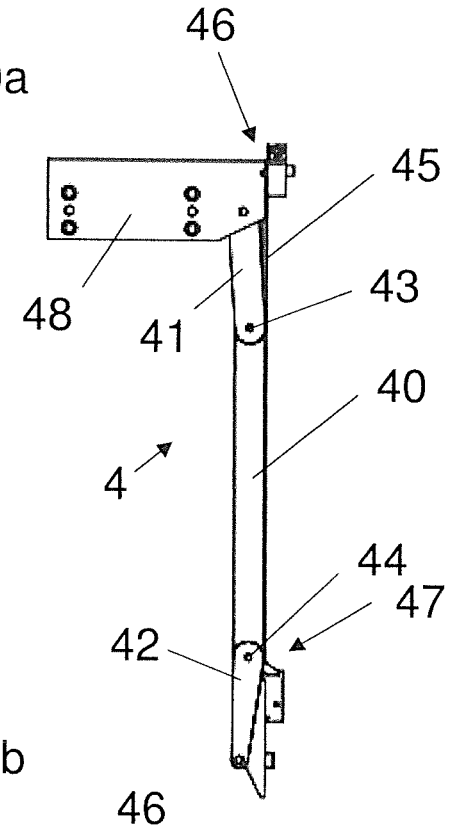
FIGS. 10*a*, 10*b* show a side view and a perspective view of a support device in a closed position.
Figure 10B:
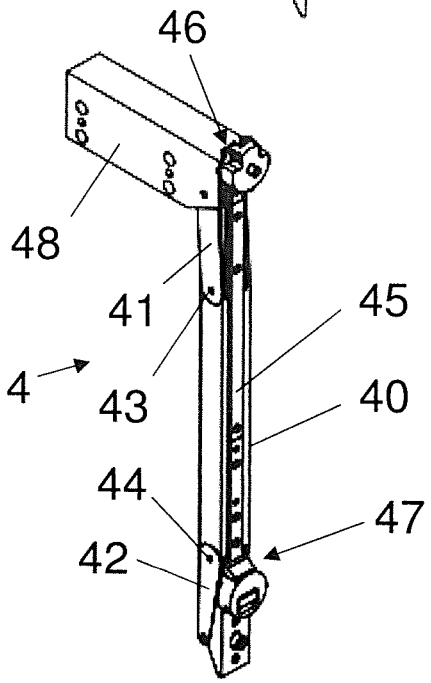

FIGS. 10*a* and 10*b* show a side view and a perspective front view of a position of the support device 4, corresponding to a closed position of a two-part furniture flap 3. In this position the transmission portion 40 is displaced relative to the guide portion 45 to the maximum in the direction of the second hinged connection 47. The first and second hinged connections 46, 47 which are in the form of a four-point and two-point concealed cup hinge respectively are respectively disposed in a position in which a flap part 31, 32 of a two-part furniture flap 3, that is intended for mounting thereto, would be respectively disposed in a perpendicular position. The first hinge lever 41, the transmission portion 40 and the second hinge lever 42 are substantially aligned with each other. In this position the first hinged connection 46 which is in the form of a four-link concealed cup hinge is disposed in a closed condition, whereas the second hinged connection 47 which is in the form of a two-point concealed cup hinge is in an opened condition.

Figure 11A:
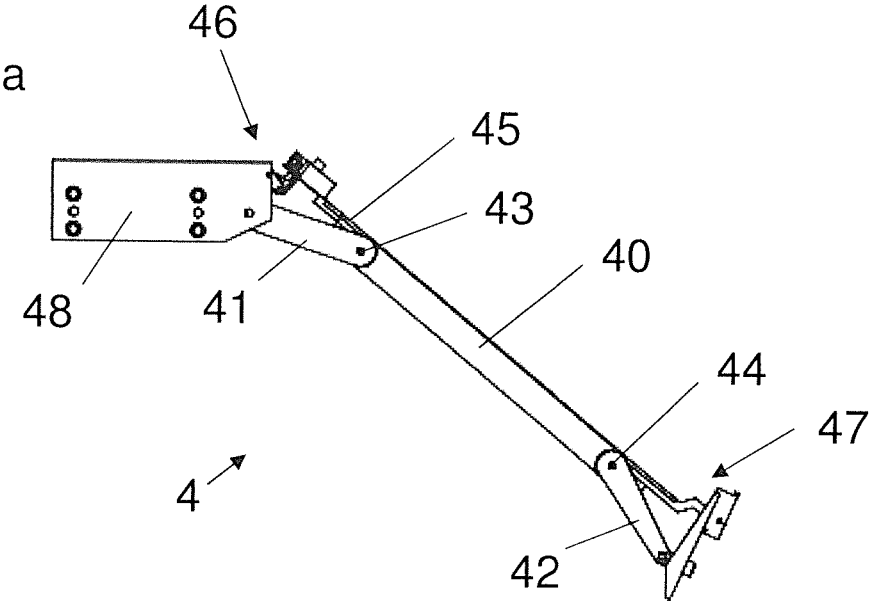
FIGS. 11*a*, 11*b* show a side view and a perspective view of a support device in an intermediate position.
Figure 11B:
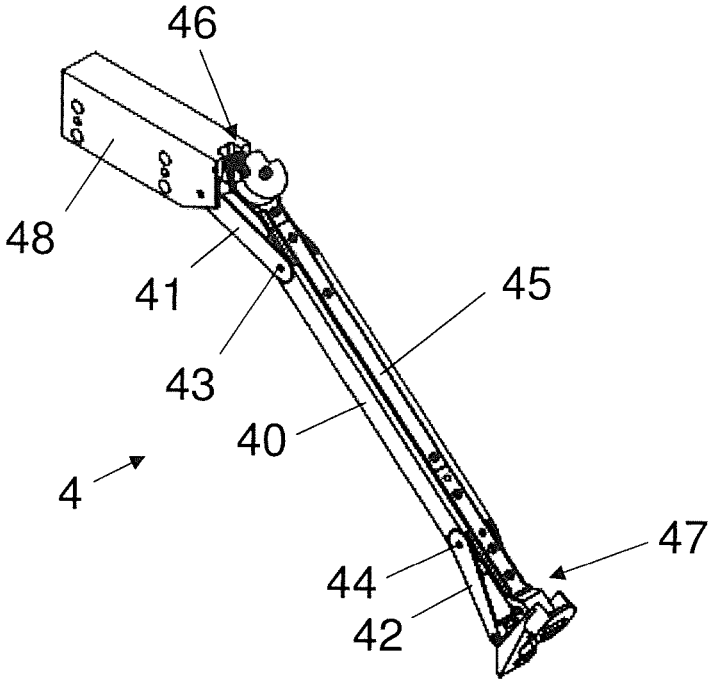

FIGS. 11*a* and 11*b* show a side view and a perspective front view respectively of a support device 4 in an intermediate position. The first hinged connection 46 which is in the form of a four-point concealed cup hinge and the second hinged connection 47 which is in the form of a two-point concealed cup hinge are disposed in this case in a partially opened and closed condition respectively. The transmission portion 40 is approximately at half the displacement travel which is possible relative to the guide portion 45, between the lower and upper end positions of the guide.

Figure 12A:
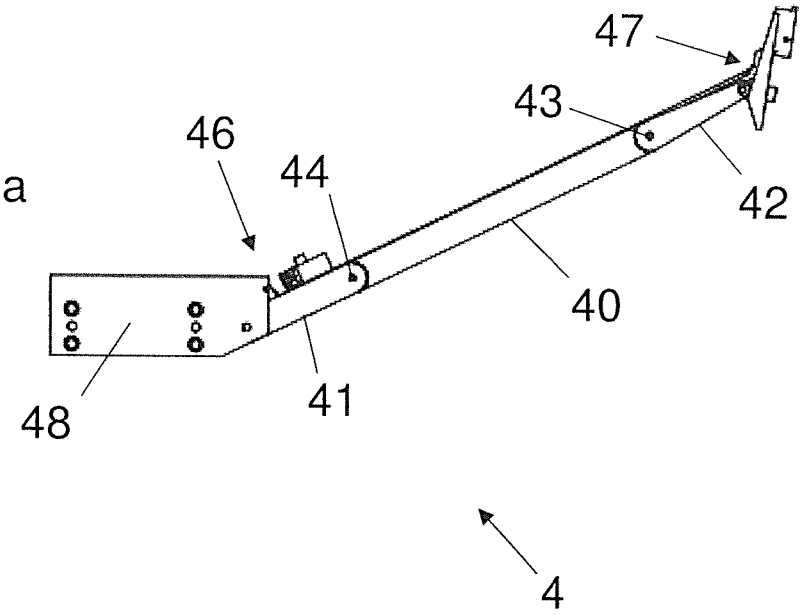
FIGS. 12*a*, 12*b* show a side view and a perspective view of a support device in an opened position.
Figure 12B:
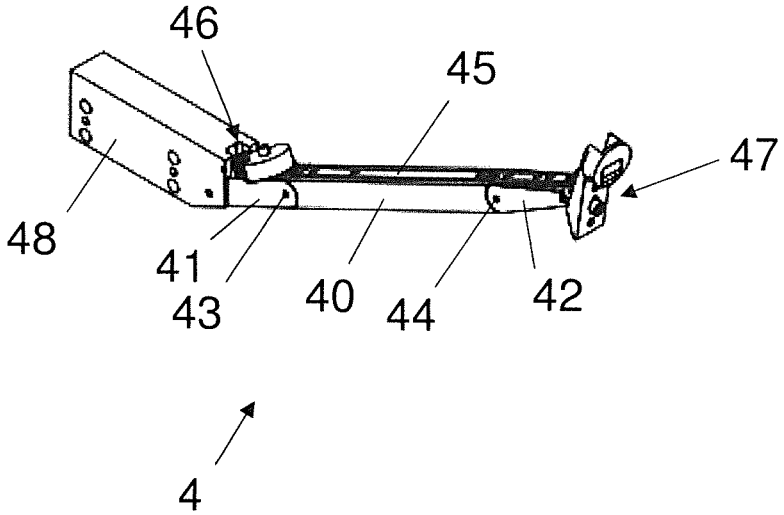

FIGS. 12*a* and 12*b* show a side view and a perspective front view respectively of a support device 4 in a position corresponding to an opened position of a two-part furniture flap 3. The first hinge lever 41, the transmission portion 40 and the second hinge lever 42 are in this case again aligned with each other. The transmission portion 40 is in an upper end position in its displacement travel relative to the guide portion 45. The first hinged connection 46 in the form of the four-point concealed cup hinge is in a completely opened condition and the second hinged connection 47 in the form of a two-point concealed cup hinge is in a completely closed condition.

Figure 13C:
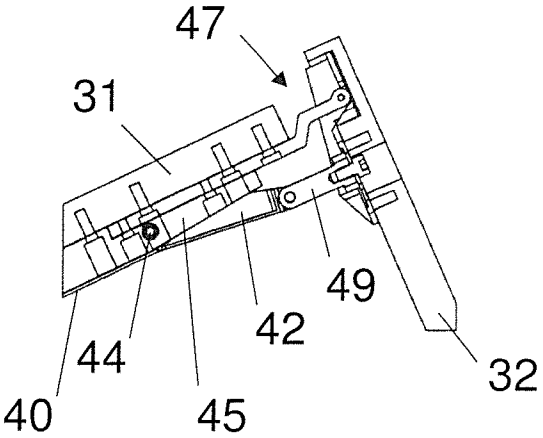
FIGS. 13*a*-13*c* show a side view in detail of a part of the support device in an opening or closing movement.
Figure 13B:
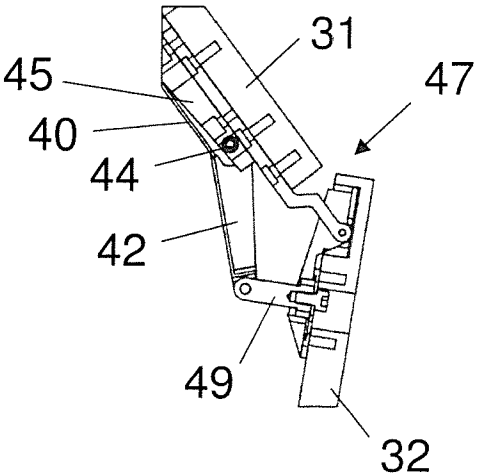
Figure 13A:
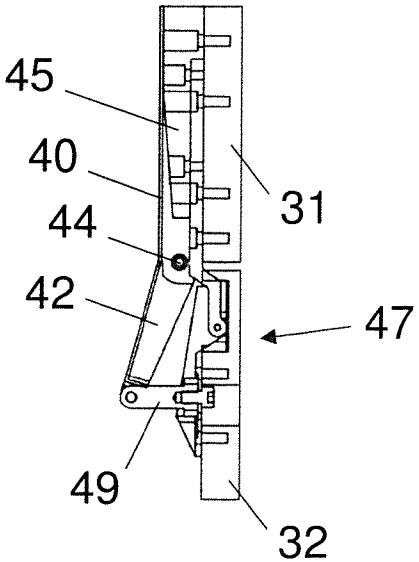

FIGS. 13*a* through 13*c* show a detail view of a portion of a two-part furniture flap 3 with a part of the support device 4 in an opening or closing movement. FIG. 13*a* shows a portion of the first flap part 31 and a portion of the second flap part 32. In addition it is also possible to see the second hinged connection 47 in the form of a two-point concealed cup hinge, thereby providing a hinged connection between the first flap part 31 and the second flap part 32. In this embodiment the second hinge lever 42 of the support device 4 is connected to the second flap part 32 by way of a fitting 49. The second hinge lever 42 further attaches to the transmission portion 40 at the second articulation point 44 thereof. The first flap part 31 can be fixed to the guide portion 45 of the support device 4 by way of screw means. The transmission portion 40 which is guided at the guide portion 45 is disposed in this position corresponding to the closed position of an article of furniture 1, in a lower end position in its displacement travel. FIG. 13*b* shows a portion of the support device 4 and the two-part furniture flap 3 in a partially opened or closed position. It can be seen here that the tilting movement of the first flap part 31, due to the relative displacement between the transmission portion 40 and the guide portion 45, has been transmitted with the transmission portion 40 by way of the second hinge lever 42 and the fitting 49 to the second hinged connection 47 and thus the second flap portion 32. FIG. 13*c* shows a part of the support device 4 and the two-part furniture flap 3 in a completely opened position. It is to be noted in this respect that the inclination of the second flap part 32 can be adjusted in the open position of the two-part furniture flap 3 by the fitting 49. In the embodiment illustrated here the second flap part 32 would incline away from the carcass 2 of an article of furniture 1, whereby it can be made easier for a user to be positioned under an opened furniture flap 3.

Figure 14:
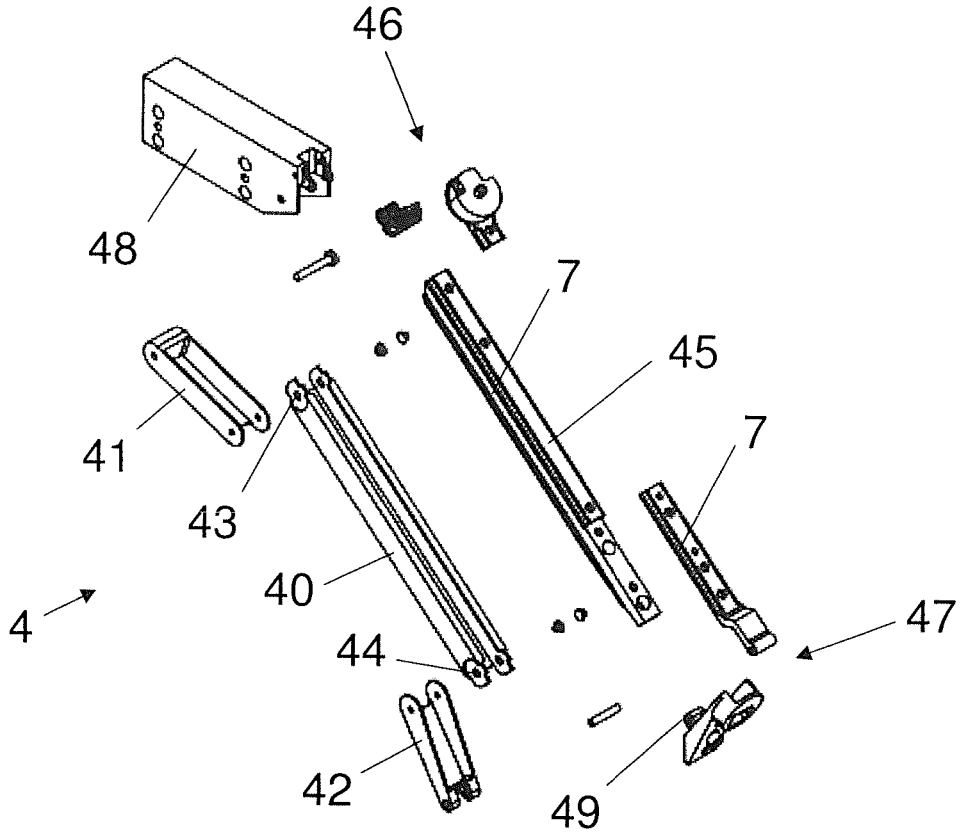
FIG. 14 shows a perspective exploded view of a support device.

FIG. 14 shows a perspective exploded view of a support device 4. In this case the housing 48, the first hinged connection 46 provided for fixing thereto and in the form of a four-point concealed cup hinge, the guide portion 45, the second hinged connection 47 in the form of a two-point concealed cup hinge with the fitting 49 fixed thereto, the second hinge lever 42, the transmission portion 40 with the first and second articulation points 43, 44 and the first hinge lever 41 can be clearly seen. In this case the guide groove 7 for linear positive guidance of the transmission portion 40 is provided sectionwise on the guide portion 45 and the arm, provided for fixing thereto, of the second hinged connection 47 in the form of a two-point concealed cup hinge. It is also possible to see on the transmission portion 40 the holding structures provided for engagement into the guide groove 7.

Figure 15:
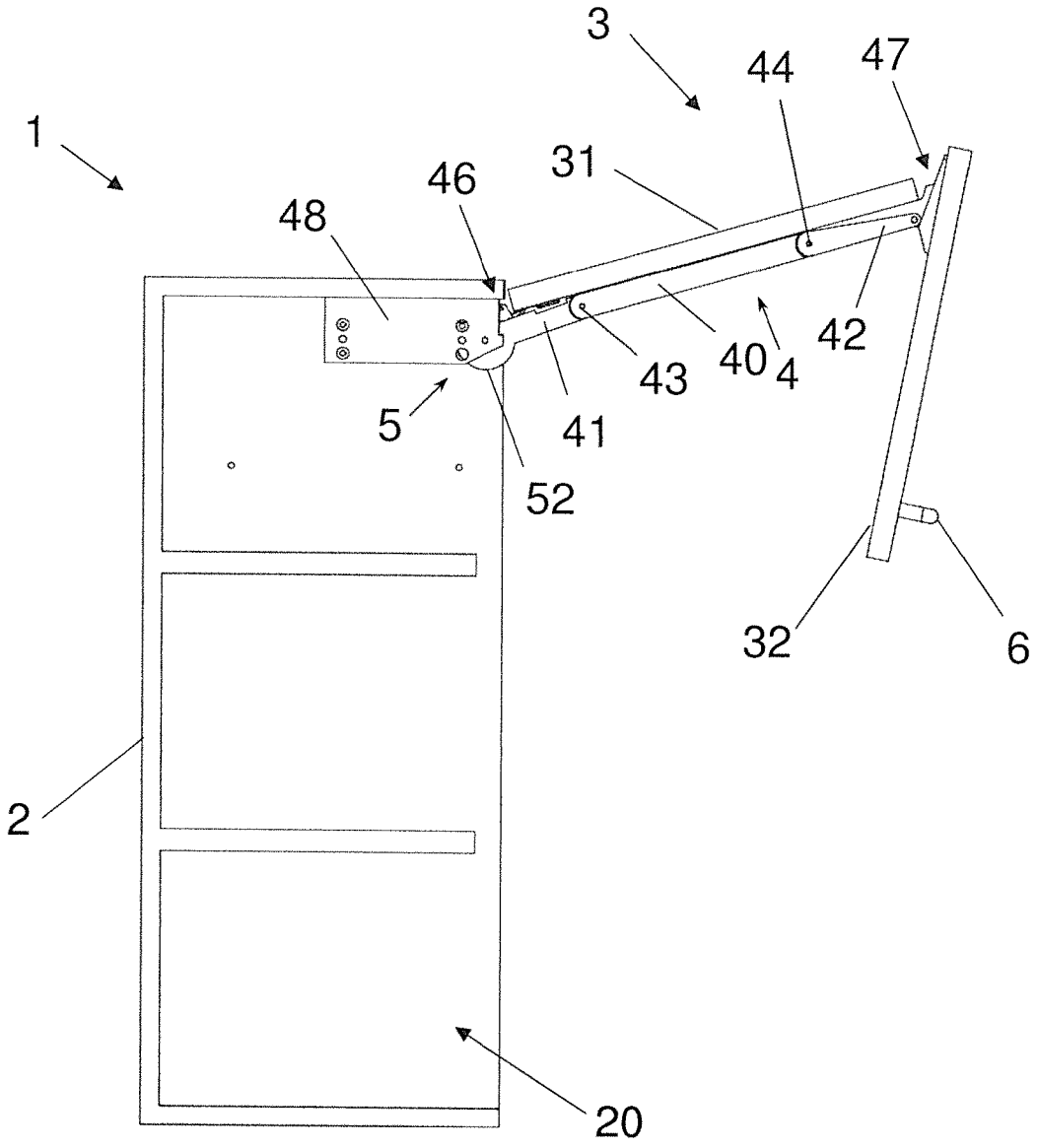
FIG. 15 shows a sectional side view of a further embodiment of an article of furniture with a two-part furniture flap and a support device in an opened position.

FIG. 15 shows an embodiment of an article of furniture 1 having a furniture carcass 2, a two-part furniture flap 3 and a support device 4, the support device 4 having a spring-loaded mechanical drive 5. In this case the drive acts on the first hinge lever 41 of the support device 4, in which case it is provided in the region of the mounting in the housing 4 with a control cam 52, thereby permitting the drive 5 to be of an integrated compact structure. The two-part furniture flap 3 can be held in an open position as shown by the spring-loaded mechanical drive 5.

Figure 16:
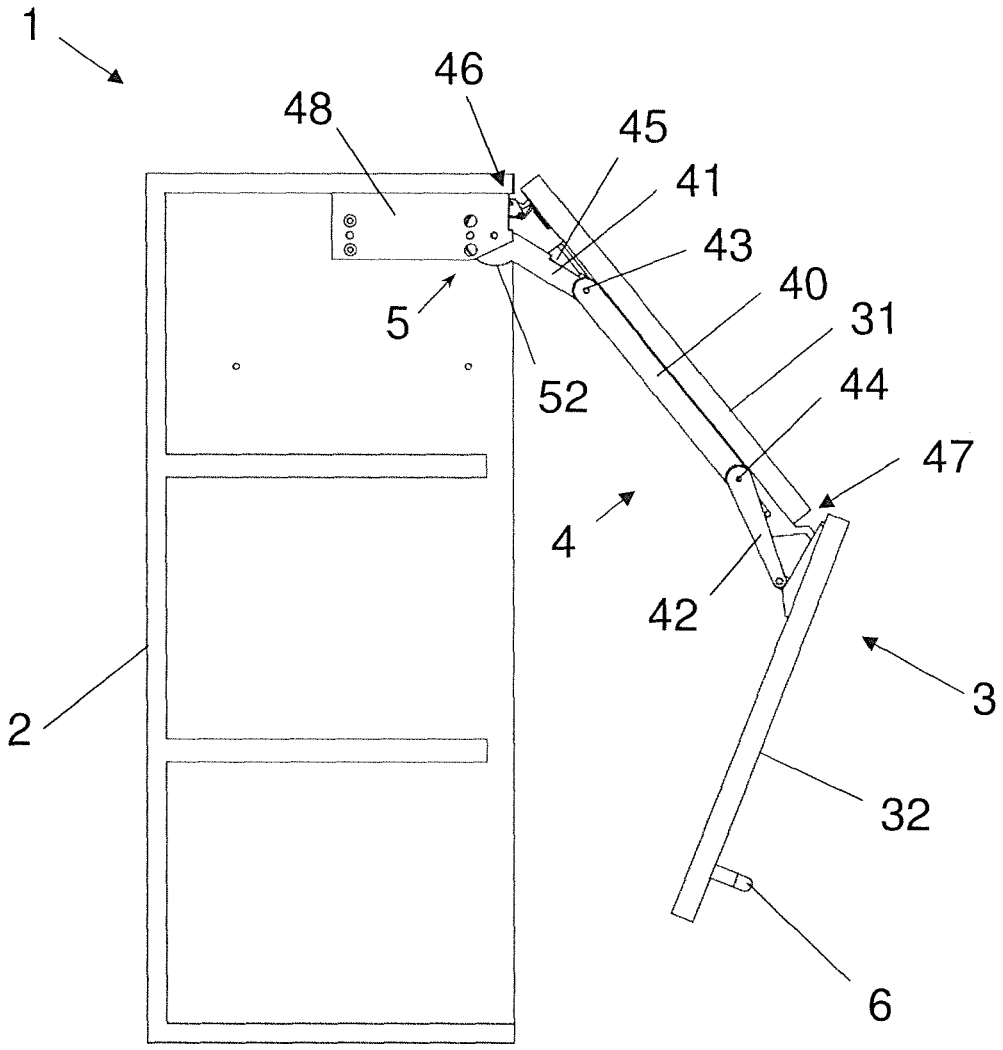
FIG. 16 shows a sectional side view of a further embodiment of an article of furniture with a two-part furniture flap and a support device in an intermediate position.

FIG. 16 shows an embodiment of an article of furniture 1 with a two-part furniture flap 3 and a support device 4 with a spring-loaded mechanical drive 5 with a partially opened or closed furniture flap 3. In this case the opening movement of the two-part furniture flap 3 can be assisted by the drive 5 or also driven over certain angular ranges.

Figure 17:
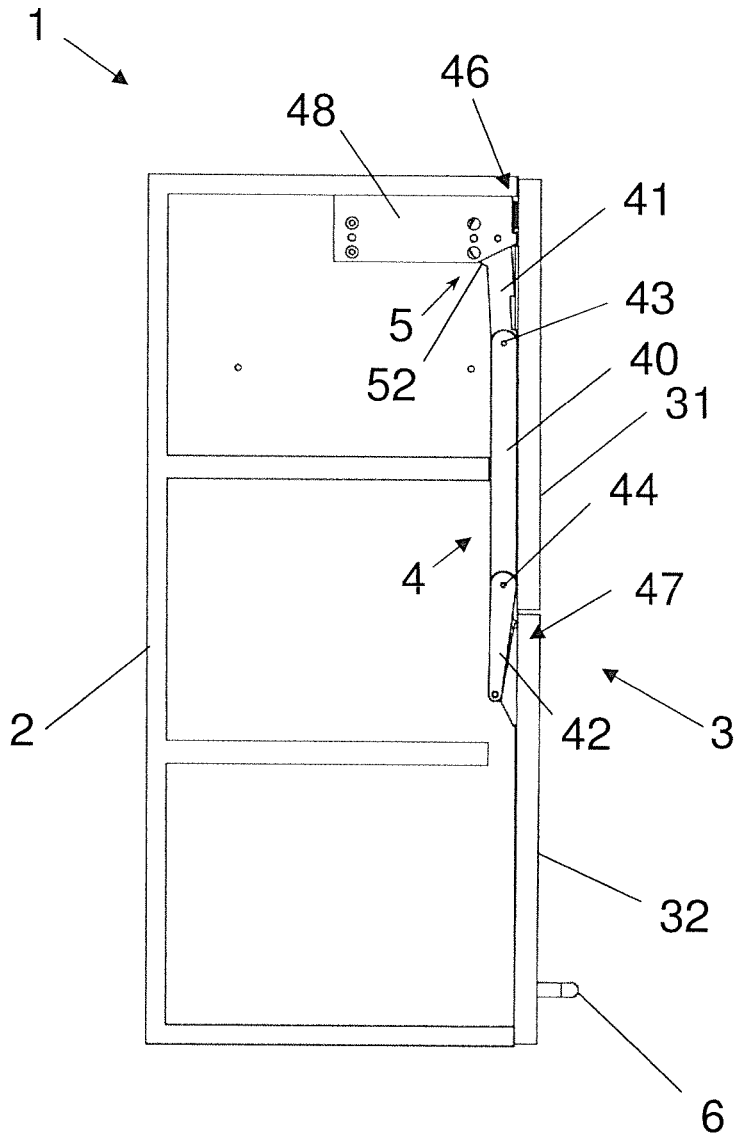
FIG. 17 shows a sectional side view of a further embodiment of an article of furniture with a two-part furniture flap and a support device.

FIG. 17 shows an embodiment of an article of furniture 1 in a closed position of the furniture flap 3, with a support device 4 having a drive 5. In this position of the support device 4 the spring-loaded mechanical drive 5 can hold the two-part furniture flap 3 in the closed position with a force which can be sufficiently easily overcome for a user.

Figure 18C:
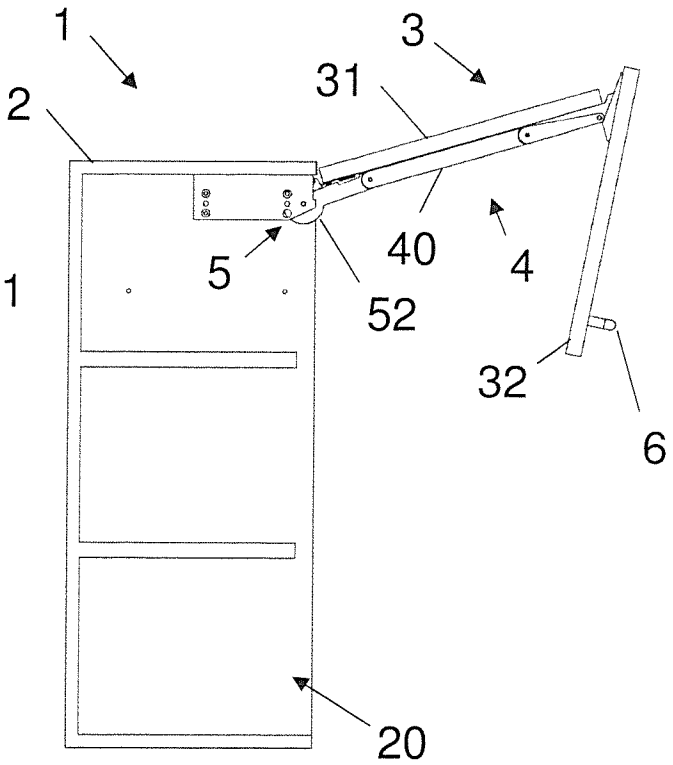
FIGS. 18*a*-18*c* show a sectional side view of a further embodiment of an article of furniture in an opening or closing movement.
Figure 18B:
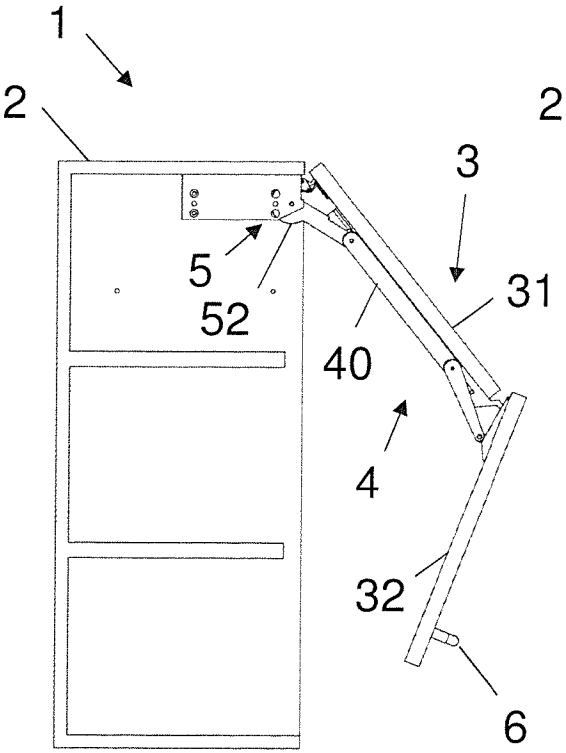
Figure 18A:
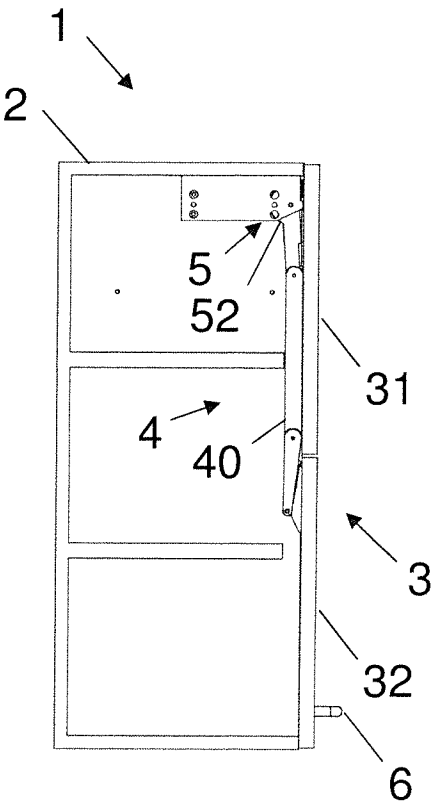

FIGS. 18*a* through 18*c* show the implementation of an opening or closing movement of an article of furniture 1 with a support device 4 provided with a drive 5 for a two-part furniture flap 3. In this case the drive 5 can assist with the closed position of the furniture flap 3, shown in FIG. 18*a*. As from a certain opening angle, as far as which the furniture flap 3 can be urged by the drive 5 into a closed position, the drive 5 can actively support opening of the furniture flap 3 and also hold it in an opened position as in FIG. 18*c*.

Figure 19A:
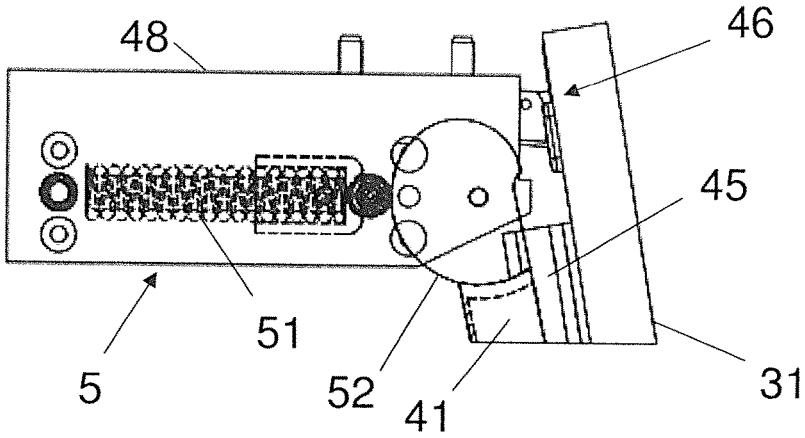
FIGS. 19*a*-19*c* show various side and perspective sectional views of a part of an embodiment of a support device with a drive.

FIG. 19*a* shows a portion of a support device 4 with a spring-loaded mechanical drive 5 and a first flap part 31 fixed thereto of a furniture flap 3. In this case the Figure shows a spring 51 which is arranged in the housing 48 and which acts on the control cam 52 provided on the first hinge lever 41.

Figure 19B:
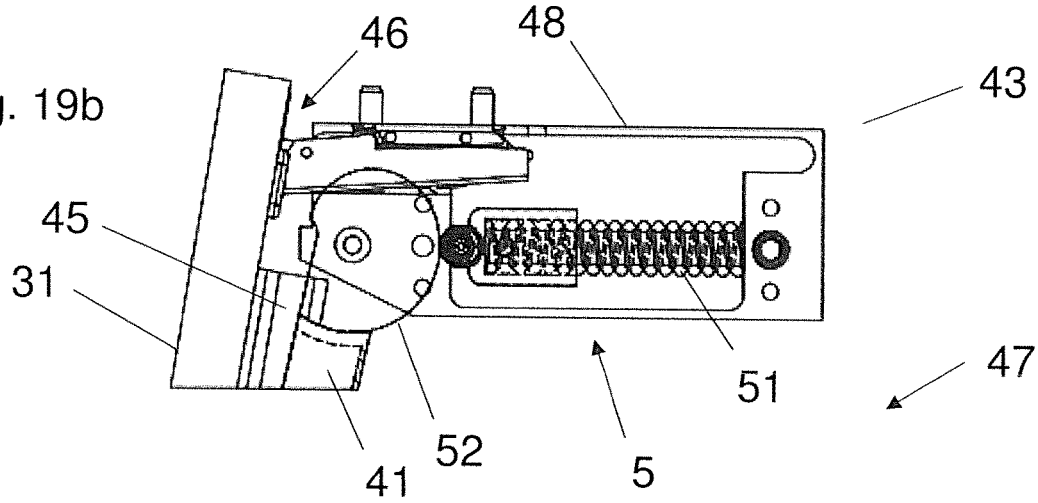
Figure 19C:
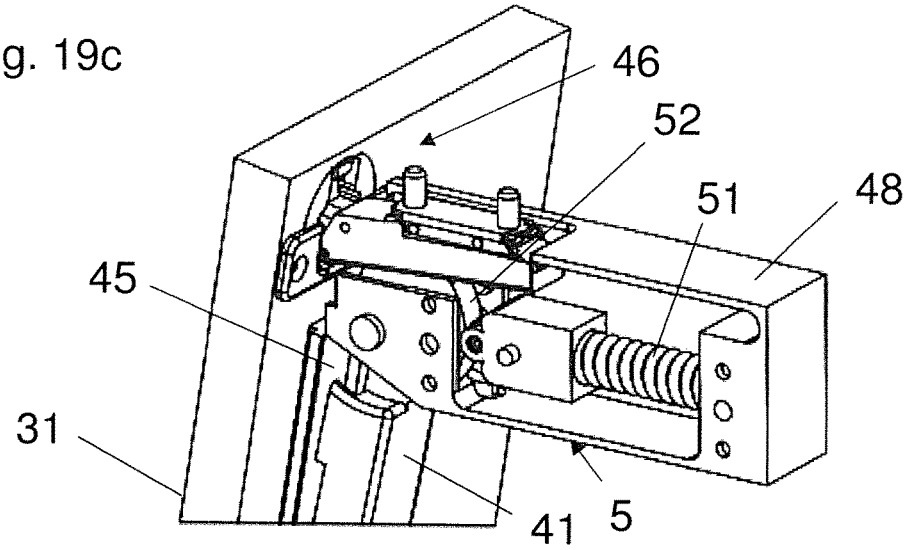

FIGS. 19*b* and 19*c* show a side view and a perspective rear view respectively of a drive 5 provided in the housing 48 of the support device 4.

Figure 20:
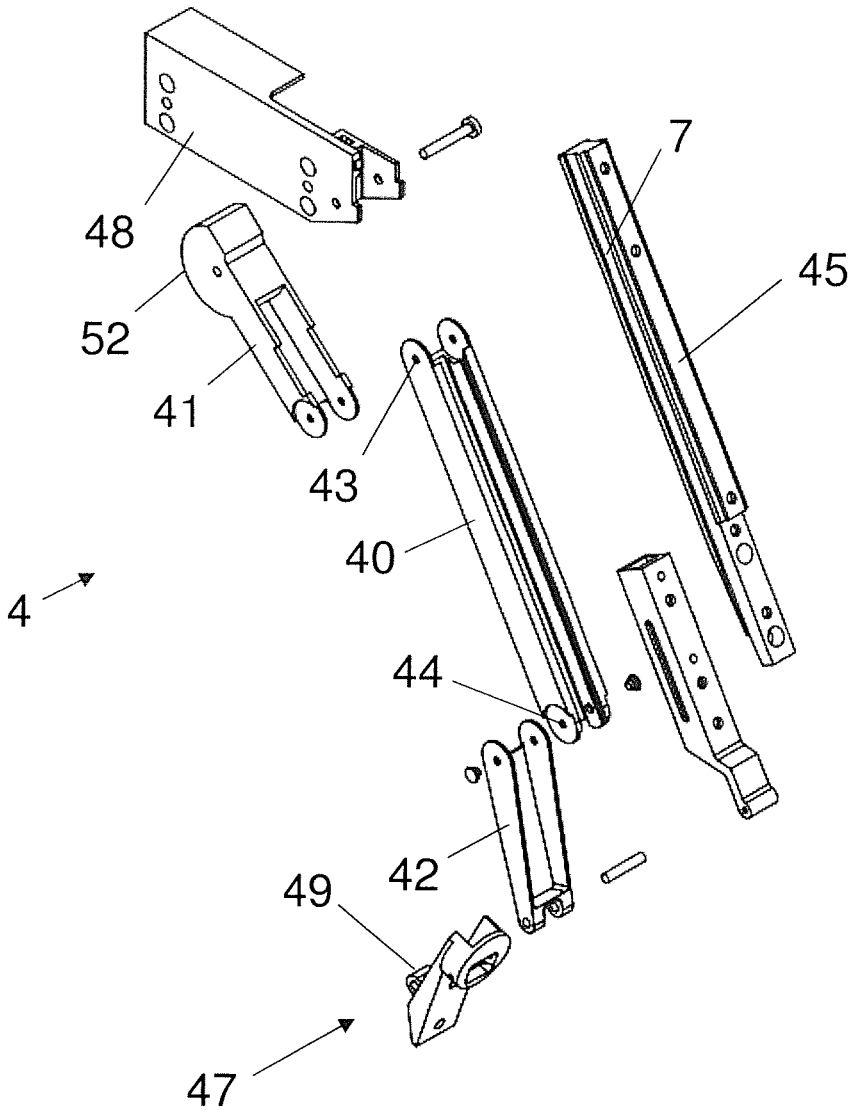
FIG. 20 shows a perspective exploded view of a further embodiment of a support device.

FIG. 20 shows a perspective exploded view of a support device 4, for which there is provided a spring-loaded mechanical drive 5. The first hinged connection 46 and the spring 51 provided for the drive are not shown in this view. It is possible to see here the housing 48, the guide portion 45, the second hinged connection 47 in the form of a two-point concealed cup hinge with a fitting 49 fixed thereto, the second hinge lever 42, the transmission portion 40 with the first and second articulation points 43, 44, and the first hinge lever 41 with the control cam 52 provided thereon. In this embodiment the guide groove 7 for positive guidance of the transmission portion 40 is provided sectionwise on the guide portion 45.

The invention claimed is:

1. An article of furniture comprising:

a furniture carcass;

a two-part furniture flap having a first flap part and a second flap part; and at least one support device for the two-part furniture flap, wherein:

the at least one support device is hingedly connected to the furniture carcass and the two-part furniture flap; and the at least one support device has a transmission portion which is at an inside of the first flap part and is linearly displaceable along the inside of the first flap part and which is configured to establish a setting angle of the second flap part relative to the first flap part in dependence on a setting angle of the first flap part.

2. The article of furniture as set forth in claim 1, wherein the transmission portion of the at least one support device is hingedly connected to the furniture carcass by a first hinge lever at a first articulation point.

3. The article of furniture as set forth in claim 2, wherein the first articulation point is at a first end of the transmission portion of the at least one support device.

4. The article of furniture as set forth in claim 1, wherein the transmission portion of the at least one support device is hingedly connected to the second flap part by a second hinge lever at a second articulation point.

5. The article of furniture as set forth in claim 4, wherein the second hinge lever is hingedly connected to the second flap part by a fitting.

6. The article of furniture as set forth in claim 4, wherein the second articulation point is at a second end of the transmission portion of the at least one support device.

7. The article of furniture as set forth in claim 1, wherein the first flap part is connected to the furniture carcass by a first hinged connection.

8. The article of furniture as set forth in claim 1, wherein the first flap part is connected to the second flap part by a second hinged connection.

9. The article of furniture as set forth in claim 8, wherein:

the transmission portion of the at least one support device is hingedly connected to the second flap part by a second hinge lever at a second articulation point; and the second hinge lever, in a mounted position, is connected to the second flap part beneath a point of rotation of the second hinged connection connecting the first flap part and the second flap part.

10. The article of furniture as set forth in claim 1, wherein:

the transmission portion of the at least one support device is hingedly connected to the furniture carcass by a first hinge lever at a first articulation point, and the transmission portion of the at least one support device and the first hinge lever are aligned with each other in a closed position of the two-part furniture flap; or the transmission portion of the at least one support device is hingedly connected to the second flap part by a second hinge lever at a second articulation point, and the transmission portion of the at least one support device and the second hinge lever are aligned with each other in the closed position of the two-part furniture flap.

11. The article of furniture as set forth in claim 1, wherein:

the transmission portion of the at least one support device is hingedly connected to the furniture carcass by a first hinge lever at a first articulation point, and the transmission portion of the at least one support device and the first hinge lever are aligned with each other in an open position of the two-part furniture flap; or the transmission portion of the at least one support device is hingedly connected to the second flap part by a second hinge lever at a second articulation point, and the transmission portion of the at least one support device and the second hinge lever are aligned with each other in the open position of the two-part furniture flap.

12. The article of furniture as set forth in claim 1, wherein:

the transmission portion of the at least one support device is hingedly connected to the furniture carcass by a first hinge lever at a first articulation point, and a ratio of a longitudinal extent of the first hinge lever to a longitudinal extent of the transmission portion of the at least one support device is less than or equal to 1/2; or the transmission portion of the at least one support device is hingedly connected to the second flap part by a second hinge lever at a second articulation point, and a ratio of a longitudinal extent of the second hinge lever to the longitudinal extent of the transmission portion of the at least one support device is less than or equal to 1/2.

13. The article of furniture as set forth in claim 1, wherein the transmission portion of the at least one support device is configured to be guided at least sectionwise by a guide linearly at a guide portion displaceable relative thereto.

14. The article of furniture as set forth in claim 13, wherein the guide is a positive guide.

15. The article of furniture as set forth in claim 13, wherein the guide portion of the at least one support device is fixed to the inside of the first flap part.

16. The article of furniture as set forth in claim 13, wherein:

the first flap part is connected to the furniture carcass by a first hinged connection, and the guide portion is connected to the first hinged connection; or the first flap part is connected to the second flap part by a second hinged connection, and the guide portion is connected to the second hinged connection.

17. The article of furniture as set forth in claim 1, wherein a ratio of a longitudinal extent of the transmission portion of the at least one support device to a height of the first flap part is at least equal to or greater than 1/3.

18. The article of furniture as set forth in claim 1, wherein a ratio of a longitudinal extent of the transmission portion of the at least one support device to a height of the first flap part is at most 0.8.

19. The article of furniture as set forth in claim 1, wherein the at least one support device has an electrical or spring-loaded mechanical drive.

20. The article of furniture as set forth in claim 19, wherein the electrical or spring-loaded mechanical drive is a spring-loaded mechanical drive, has a force storage, and a control cam or a multi-link kinematic arrangement is configured to be acted upon with force by the force storage.

21. The article of furniture as set forth in claim 19, wherein:

the transmission portion of the at least one support device is hingedly connected to the furniture carcass by a first hinge lever at a first articulation point; and the spring-loaded mechanical drive is configured to act on the first hinge lever.

22. The article of furniture as set forth in claim 1, wherein the first flap part is arranged upwardly in a mounted position.

23. The article of furniture as set forth in claim 1, wherein the second flap part is arranged downwardly in a mounted position.

24. The article of furniture as set forth in claim 2, wherein the first hinge lever is arranged upwardly in a mounted position.

25. The article of furniture as set forth in claim 4, wherein the second hinge lever is arranged downwardly in a mounted position.

26. The article of furniture as set forth in claim 14, wherein the positive guide includes a groove rail.

27. The article of furniture as set forth in claim 17, wherein the ratio of the longitudinal extent of the transmission portion of the at least one support device to the height of the first flap part is at least equal to or greater than 1/2.

28. The article of furniture as set forth in claim 20, wherein the force storage includes at least one spring.

29. A support device for a two-part furniture flap, the support device comprising:

a housing which can be fixed to an article of furniture;

a transmission portion;

a first hinge lever hingedly connected to the housing and positioned at a first articulation point of the transmission portion;

a second hinge lever positioned at a second articulation point of the transmission portion;

a guide portion which can be fixed to a first flap part of the two-part furniture flap;

a first hinged connection for connecting the housing to the guide portion; and a second hinged connection for connecting the guide portion to the second hinge lever and fixing a second flap part of the two part furniture flap.

30. The support device as set forth in claim 29, wherein the guide portion is configured to linearly guide the transmission portion along the first flap part.

* * * * *